US011054234B2

(12) United States Patent
Thomas

(10) Patent No.: US 11,054,234 B2
(45) Date of Patent: Jul. 6, 2021

(54) FIRING MECHANISM FOR A GRENADE, A GRENADE AND A METHOD OF OPERATING A GRENADE

(71) Applicant: AMTEC Less Lethal Systems, Inc., Perry, FL (US)

(72) Inventor: Duncan Thomas, Birmingham (GB)

(73) Assignee: ALS, Inc., Perry, FL (US)

( * ) Notice: Subject to any disclaimer, the term of this patent is extended or adjusted under 35 U.S.C. 154(b) by 0 days.

(21) Appl. No.: 15/572,057

(22) PCT Filed: Jun. 6, 2016

(86) PCT No.: PCT/GB2016/051663
§ 371 (c)(1),
(2) Date: Nov. 6, 2017

(87) PCT Pub. No.: WO2016/203200
PCT Pub. Date: Dec. 22, 2016

(65) Prior Publication Data

US 2018/0135954 A1 May 17, 2018

(30) Foreign Application Priority Data

Jun. 16, 2015 (GB) ..... 1510478

(51) Int. Cl.
*F42C 15/00* (2006.01)
*F42B 27/00* (2006.01)
(Continued)

(52) U.S. Cl.
CPC ..... *F42C 15/005* (2013.01); *F42B 27/00* (2013.01); *F42C 14/02* (2013.01); *F42C 15/44* (2013.01); *F42B 8/26* (2013.01)

(58) Field of Classification Search
CPC ..... F42C 15/005; F42C 14/02; F42C 15/44; F42C 15/00; F42C 15/18; F42C 15/184;
(Continued)

(56) References Cited

U.S. PATENT DOCUMENTS 1,481,635 A * 1/1924 Councilman ..... F42C 1/06 102/260
2,701,527 A * 2/1955 Granath ..... F42C 15/24 102/242
(Continued)

FOREIGN PATENT DOCUMENTS

EP 1705454 9/2006
EP 3059544 8/2016

OTHER PUBLICATIONS

GB Office Action for GB App. No. GB1510478.9, dated Oct. 20, 2020.

*Primary Examiner* — Michelle Clement
(74) *Attorney, Agent, or Firm* — Remenick PLLC

(57) ABSTRACT

A grenade firing mechanism (12) includes a body (24) containing a firing pin (20) and a tiring pin actuator mechanism (22). A safety system includes twist to arm collar (70) and a safety interlock (92). The collar is movable between an unarmed position and an armed position and tire safety interlock is movable between a collar locking position, a collar release position and a firing position. When the collar (70) is in the unarmed position and the safety interlock (92) is in the collar locking position, actuation of the firing pin (20) is inhibited and the safety interlock (92) inhibits movement of the collar to the armed position. When, the safety interlock (92) is in the collar release position, the collar (70) is able to be moved between said unarmed and armed positions and actuation of the firing pin is inhibited. When the collar (70) is in the armed position and the -safety
(Continued)

interlock (92) is in the firing position, actuation of the firing pin is enabled.

29 Claims, 7 Drawing Sheets

(51) Int. Cl.
*F42C 14/02* (2006.01)
*F42C 15/44* (2006.01)
*F42B 8/26* (2006.01)

(58) Field of Classification Search
CPC ..... F42C 15/192; F42C 15/34; F42B 27/00; F42B 8/26
USPC ..... 102/221
See application file for complete search history.

(56) References Cited

U.S. PATENT DOCUMENTS 3,498,223 A * 3/1970 Andersson ..... F42C 14/02 102/221
3,742,855 A * 7/1973 Webb ..... F42C 14/02 102/487
3,842,740 A * 10/1974 Mirlesse ..... F42C 14/02 102/487
4,128,061 A * 12/1978 Kaiser ..... F42C 15/188 102/249
4,285,277 A * 8/1981 Lerman ..... F42C 14/02 102/223
4,430,938 A * 2/1984 Jander ..... F42C 15/005 102/232
4,704,965 A * 11/1987 Kratz ..... F42C 15/184 102/226
4,777,879 A * 10/1988 Bueno ..... F42C 15/184 102/226
4,899,659 A * 2/1990 Hardt ..... F42C 15/188 102/229
5,549,047 A * 8/1996 Borgni ..... F42C 9/16 102/256
5,609,357 A * 3/1997 Amano ..... B60R 21/33 102/274
5,615,911 A * 4/1997 Amano ..... B60R 21/33 102/274
6,336,407 B1 * 1/2002 Adimari ..... F42C 9/142 102/259
6,481,355 B2 * 11/2002 Weber ..... F42C 1/04 102/264
6,792,868 B2 * 9/2004 Teilhol ..... F42C 14/02 102/482
7,322,296 B2 * 1/2008 Ellis ..... F42B 8/26 102/482
7,587,979 B2 * 9/2009 Rastegar ..... F42C 9/02 102/222
8,381,651 B1 * 2/2013 Presutti, Jr. ..... F42C 9/10 102/202.13
8,561,540 B1 * 10/2013 Lauch ..... F42C 15/188 102/258
9,638,503 B1 * 5/2017 Andrews ..... F42C 15/005
9,846,019 B1 * 12/2017 Graf ..... F42C 14/02
2007/0283833 A1 * 12/2007 George Ellis ..... F42B 8/26 102/498

* cited by examiner

FIRING MECHANISM FOR A GRENADE, A GRENADE AND A METHOD OF OPERATING A GRENADE

CROSS-REFERENCES TO RELATED APPLICATIONS

This is a U.S. National Stage filing made pursuant to 35 U.S.C. § 371. This U.S. application claims the benefit of a prior Patent Cooperation Treaty filing that was assigned Application No, PCT/GB2016/051663. The earliest priority date in the parent application is Jun. 16, 2015.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

The present invention relates to firing mechanisms for grenades.

2. Description of the Related Art

Grenades are known which contain a charge that is set off when the grenade is thrown. Grenades may contain, an explosive charge contained in a housing that fragments when the charge is detonated so as to cause physical harm to personnel and equipment in the vicinity. Also known are stun grenades, sometimes also referred to as diversionary devices or distraction devices that are generally intended for use by law enforcement and military personnel to physiologically and psychologically stun an intended victim in high-risk situations but without, causing significant physical, damage. Known stun grenades generally comprise a housing containing a deflagrating pyrotechnic charge and a detonation mechanism with a small time delay. When detonated, the known stun grenades emit a loud noise, pressure and a flash of light to stun the intended victim but without expelling matter that might cause physical injury to the intended victim or anyone else in the vicinity. It is also known to provide training grenades that contain only a small primer charge and which can be used to practice deployment of explosive and/or stun grenades.

The term "grenade" as used herein, and in particular in the claims, is intended to encompass ad such, grenade devices including explosive grenades, stun grenades or diversionary devices, and practice grenades unless expressly stated otherwise.

A particular concern with grenades is to ensure that they do not go off unintentionally, especially when being held prior to deployment.

Grenades typically comprise a firing mechanism for setting off the charge when the grenade is thrown. In one known arrangement, the grenade houses a primer charge that is set off when struck by a firing pin. The primer charge is often used to ignite a fuze which sets off a main charge after a short time delay. In a common firing mechanism used for grenades, a striker plate with a firing pin is resiliently biased by a spring to a firing position in which the firing pin contacts the primer charge. The plate is initially held In a non-firing position k which the firing pin is spaced from the primer charge against the bias force by means of a release lever. The firing arrangement will usually also Include a removable safety pin for holding the lever in a non-release position where it extends adjacent the body of the grenade. To tire the grenade, a user grasps the grenade in one hand holding the lever on to the body of the grenade to hold the striker plate in its non-firing position. The user removes the safety pin with the other hand and then throws the grenade. This releases the lever which is moved away from the body by the spring acting on the striker plate allowing the striker plate to move to the firing position to contact the primer charge.

Whilst this known arrangement works well there are drawbacks. The grenade has to be held in a particular orientation so that the user can grasp the handle and access the safety pin. The safety pin may be difficult to remove, especially when wearing gloves. A particular problem is that once the safety pin has been removed it is not easily or reliably re-insertable. This makes it difficult to render the grenade safe if a decision is made not to deploy the grenade after the pin has been removed. US 2007/0283833 A1 discloses an alternative firing mechanism for a training grenade in which a firing pin is moved to strike a primer charge by means of an inertia toggle. The toggle is mounted in the body of the grenade so that it can pivot relative to the body and is attached to the firing pin by a ball and socket joint When the grenade is thrown and the body hits the ground or a solid object, the inertia of the toggle causes the toggle to pivot or move axially inwardly which moves the firing pin to strike the primer charge. This tiring mechanism has the advantage that it is easy to use, does not require the grenade to be held in any particular orientation, and has no safety pin to remove. However, there is a risk that the firing mechanism could be activated unintentionally, say if the grenade is dropped or knocked. This might happen for example if a user were to unintentionally hit a solid object or another person whilst in the act of throwing the grenade.

There is a need for an improved firing mechanism for a grenade which overcomes or reduces the disadvantages of the known firing mechanisms and tor a grenade having such a firing mechanism and to a method of using such a grenade. There is need for a firing mechanism for a grenade which is easier to use, especially in adverse operating conditions and/or whilst using gloves. There is also a need for a firing mechanism for a grenade in which the chances of the grenade being set off unintentionally are reduced.

BRIEF SUMMARY OF THE PRESENT INVENTION

According to a first aspect of the present invention there is provided a firing mechanism for a grenade comprising: a body containing a firing system including a firing pin and an actuator mechanism for actuating the firing pin; a safety system including an arming collar mounted to the body for movement between an unarmed position and an armed position and a safety interlock mounted to the body for movement between a collar locking position, a collar release position and a firing position, the safety interlock being biased by a safety interlock bias mechanism in a first direction towards the collar locking and firing positions from the collar release position; wherein the firing mechanism is configured such that: when the collar is in said unarmed position and the safety interlock is in said collar locking position, actuation of the firing pin is inhibited and the safety interlock inhibits movement of the collar to said armed position; when the safety interlock is in said collar release position, the collar can be moved between said unarmed and armed positions and actuation of the firing pin is inhibited; when the collar is in the armed position and the safety interlock is in the firing position, actuation of the firing pin is enabled.

The collar locking position and the firing position of the safety interlock may be the same, in which case the arming collar may be operative to inhibit actuation of the firing pin when in said unarmed position. The collar locking position and the firing position of the safety interlock may be different, in which case, the safety interlock may be being operative to inhibit actuation of the firing pin except when in said firing position and the arming collar may prevent the safety interlock from being moved to said firing position when in said unarmed position but allow movement of the safety interlock to said firing position when in said armed position. In one-embodiment, the-safety interlock must be moved in the first direction beyond said collar locking position from said collar release position to reach said firing position.

The safety interlock may be mounted to the body so as to be manually depressed to said collar release position against the bias force of the safety interlock bias mechanism. The safety interlock may comprise a button slidably or pivotally mounted to the body.

In an embodiment, the actuator comprises an inertia toggle movably mounted to the body to actuate the firing pin.

In an embodiment the actuator comprises a firing pin biasing mechanism operative to move the firing pin relative to the body from an initial position in a firing direction. The firing pin biasing mechanism may be a spring for urging the pin in the firing direction from said initial position. The mechanism may include a damping arrangement for regulating movement of the firing pin. The damping arrangement may be a fluid damper operative to restrict the rate of movement of the firing pin in the firing direction from said initial position over at least a part of a range of movement of the firing pin. In an embodiment, the damping arrangement comprises a chamber defined between the firing pin and one of the body and a component fixed relative to the body, which chamber increases in volume as the firing pin moves in the firing direction from said initial position over said at least part of its range of movement, the chamber having a restricted fluid inlet through which air is able to enter the chamber as the volume of the chamber increases, the arrangement being configured such that, over said at least a part of the range of movement of the firing pin, a partial vacuum is generated in the chamber.

The collar and the safety interlock may engage with one another when the collar is in said unarmed position and the safety interlock is in said collar locking position to prevent the collar moving to said armed position.

Where the actuator includes a toggle, the collar may engage the toggle when the collar is in said unarmed position to inhibit movement of the toggle relative to the firing mechanism body in a direction to actuate the firing pin. The safety interlock may engage with a component of the firing mechanism to inhibit actuation of the firing pin at least when the safety interlock is in the collar released position, the safety interlock being disengaged from said component when in the firing position. In an embodiment, the safety interlock engages with a component of the firing mechanism to inhibit actuation of the firing over its range of movement at and between said collar locking position and said collar release position, the safety interlock being movable in the first direction beyond the collar locking position to said firing position. The arming collar may engage the safely interlock to prevent it from moving beyond said collar locking position to said firing position when the arming collar is in said unarmed position.

The component of the firing mechanism engaged by the safety interlock may be the firing pin or a component operatively connected with the firing pin. The firing pin may be part of a firing pin assembly and the safety interlock may engage with any part of the firing pin assembly to inhibit actuation of the firing pin.

In accordance with a second aspect of the invention, there is provided a firing mechanism for a grenade comprising: a body containing a firing system Including a firing pin and a toggle actuator mechanism for moving the firing pin in a firing direction from an initial position, the body having a longitudinal axis; a safety system including an arming collar and a safety interlock button, the arming collar being mounted to the body by inter-engaging formations arranged such that rotation of the collar about the longitudinal axis of the body causes the collar to move linearly relative to the body in the direction of said longitudinal axis between an unarmed position and an armed position, the safety interlock button being mounted to the body for movement radially in a direction generally perpendicular to the longitudinal axis of the body between a collar release position, a collar locking position, and a firing position, the button being biased radially outwardly towards the collar locking and firing positions from the collar release position; wherein the firing mechanism is configured such that: when the collar is in said unarmed position and the safety Interlock is in said collar locking position, the collar engages with the actuator toggle to prevent the toggle from actuating the firing pin and the safety interlock button engages the arming collar to prevent it being moved to the armed position; when the safety interlock button is in said collar release position it is disengaged from the arming collar to permit the arming collar to be moved from the unarmed position to the armed position and is engaged with a component of the firing mechanism to prevent firing pin from moving in the firing direction; when the collar is in the armed position, the safety interlock button can be moved by the bias force to the firing position in which it is disengaged from said component of the firing mechanism to enable actuation of the firing pin by the toggle actuator.

The collar locking position and the firing position of the safety interlock button may be substantially the same. Alternatively, in an embodiment the safety interlock button also engages said component of the firing mechanism to prevent the firing pin being moved in the firing direction when in the collar locking position, the safety interlock button disengaging said component of the firing mechanism only when moved to a firing position radially outside of the collar locking position, the arming collar engaging the safety Interlock button when in said unarmed position to prevent the safety interlock button being moved beyond the collar locking position to the firing position. In accordance with a third aspect of the invention, there is provided a firing mechanism for a grenade comprising: a body containing a firing system including a firing pin and an actuator spring for biasing the firing pin in a firing direction from an initial position, the body having a longitudinal axis; a safety system Including an arming collar and a safety interlock button; the arming collar being mounted to the body by inter-engaging formations arranged such that rotation of the collar about the longitudinal axis of the body causes the collar to move linearly relative to the body in the direction of said longitudinal axis between an unarmed position and an armed position; the safety interlock button being mounted to the body for radial movement in a direction generally perpendicular to the longitudinal axis of the body between a collar release position, a collar locking position and a firing position, said firing position being radially outside of said collar locking position and the button being biased radially outwardly towards the collar locking and firing positions from the collar release position; the safety interlock button engaging-with one of the firing pin and a component fixed relative to the firing pin to prevent the firing pin being moved in said firing direction from said initial position when in said collar locking position and said collar release position and at all positions in between, the safety interlock button being disengaged from said one of the firing pin and a component fixed relative to the firing pin to permit movement of the firing pin in the firing direction when In said firing position; wherein, the firing mechanism is configured such that: the safety interlock button can be manually depressed inwardly from said collar locking position to said collar release position against the bias; when the collar is in said unarmed position and the safety interlock is in said collar locking position, the safety interlock button engages the arming collar to prevent the arming collar being moved to the armed position and the arming collar engages the safety interlock button to prevent the safety interlock button being moved to the firing position; when the safety interlock button is in said collar release position it is disengaged from the arming collar to permit the arming collar to be moved from the unarmed position to the armed position; and when the arming collar is in the armed position, the safety interlock button can be moved by the bias force to the tiring position.

In accordance with a fourth aspect of the invention, there is provided a firing mechanism for a grenade comprising:

a body containing a firing system including a firing pin and an actuator mechanism for moving the firing pin in a firing direction from an initial position, the body having a longitudinal axis; a safety system including an arming collar and a safety interlock, the arming collar being mounted to the body by inter-engaging formations arranged such that rotation of the collar about the longitudinal axis of the body causes the collar to move linearly relative to the body in the direction of said longitudinal axis between an unarmed position and an armed position; the safety interlock, comprising at least one interlock member movable between at least a locked position in which it inhibits movement of the firing pin from said initial position in the firing direction and an unlocked position in which it does not inhibit movement of the firing pin from said initial position in the firing direction; wherein the firing mechanism is configured such that: when the collar is in said unarmed position and the at least one safety interlock member is in said locked position the safety interlock member is prevented from moving from the locked position to the unlocked position; and when the collar is in the armed position the at least one locking member is able to be displaced to the unlocked position.

In an embodiment, the actuator mechanism is a toggle actuator, the arming collar engaging with the actuator toggle when in its unarmed position to inhibit the toggle from actuating the firing pin, the arming collar being disengaged from the actuator toggle when in its armed position collar so as not to inhibit the actuator toggle from actuating the firing pin. The firing mechanism may comprise a resilient bias member, such as a helical-compression spring, for biasing the firing pin into abutting contact with the toggle actuator.

In an alternative embodiment, the actuator mechanism comprises a resilient member for biasing the firing pin from the initial position in the firing direction. The at least one Interlock member may be movably mounted in a through hole in a wall of the body and arranged such that when in the locked position, a portion of the interlock member projects-into an interior cavity of the body In which the firing pin is located for engagement with the firing pin to prevent the firing pin moving axially in the firing direction from its initial position, the interlock member being movable radially outwardly relative to the longitudinal axis to the unlocked position in which the said portion no longer projects into the interior cavity and so does not prevent the firing pin moving in the firing direction only when the arming collar is in the armed position. The arming collar may have a recess defined in an inner surface which aligns with the interlock member when the arming collar is in the armed position, a portion of the Interlock member being received In the recess when in the unlocked position.

In an embodiment, the safety interlock may comprise two or more safety interlock members in the form of locking balls, each slidably revived in a respective through hole in the wall of the body, the collar having an arcuate groove which aligns with the balls when the collar is in the armed position. The inner surface of the collar may have an abutment surface which engages with an outer portion of the locking balls or other interlocking members to hold them in the locked position when the collar is in the unarmed position. The interior cavity may be a cylindrical bore and the firing pin may have a piston portion which is a sliding fit in the bore and the at least one interlock member may engage with the piston portion when in the locked position. In an alternative embodiment, the interlock member is a button movable in a radial direction between said locked and unlocked positions. The button may movable between a collar locking position, a collar release position radially inside the collar locking position and a firing position radially outboard of the collar locking position, the button being biased radially outwardly towards the firing position, wherein: when the collar is in said unarmed position and the safety interlock is in said collar locking position, the safety interlock button engages the arming collar to prevent the arming collar being moved to the armed position and is prevented from moving to the firing position by the arming collar, the button also contacting the firing pin or a component operatively connected with the firing pin, to inhibit movement of the firing pin from said initial position in the firing direction; when the button, is in the collar release position, the button is disengaged from the arming collar to permit the arming collar to be moved to the armed position, the button contacting the firing pin, or a component operatively connected with the firing pin, to inhibit movement of the firing pin from said initial position in the firing direction; when the collar is in the armed position, the button is able to move beyond the collar release position to the firing position under the influence of the bias force, the button in the firing position being disengaged from the firing pin, or said component operatively connected with the firing pin such that it does not inhibit movement of the firing pin from said initial position in the firing direction.

In this embodiment, the firing position of the button can be considered as the unlocked position whilst the collar locking and collar release positions can both be considered locked positions.

In accordance with a fifth aspect of the invention, there is provided a grenade comprising a firing mechanism in accordance with any one of the first, second, third, or fourth aspects of the invention, wherein the grenade further comprises a munitions compartment connected to the body of the firing mechanism.

The munitions compartment may be releasably connected to the body by means of a threaded connection. The munitions compartment may be adapted to hold a primer charge which can be struck by the fining pin when the firing pin is moved in a firing direction by the actuator. The munitions compartment may be adapted to hold a cartridge having a pyrotechnic charge and a fuze.

The grenade may be a flash grenade, or a stun grenade, or a training grenade, or a deflagrating grenade, or a diversionary device, or an explosive grenade.

In accordance with a sixth aspect of the invention, there is provided a method of using a firing mechanism in accordance with any one of the first, second, or third aspects of the invention or a grenade in accordance with the fifth aspect of the invention, the method comprising;

(a) with the collar in said unarmed position and the safety interlock in said collar locking position, applying a force to the safety interlock such that it moves against said safety interlock bias mechanism from said collar locking position to said collar release position; (b) moving the collar from said unarmed position to said armed position whilst maintaining the force on the safety interlock to hold it in the collar release position; and, (d) removing the force applied to the safety interlock such that it is moved by said safety interlock bias mechanism from said collar release position towards said firing position.

The step of moving the collar from said unarmed position to said armed position may comprise twisting the collar relative to firing mechanism body in a first rotary direction. The step of applying a force to the safety interlock such that it moves against said safety interlock bias mechanism from said collar locking position to said collar release position may comprise a user grasping the firing mechanism in one hand and manually depressing the safety interlock using the thumb and/or at least one finger of said one hand. The step of moving the collar from said unarmed position to said armed position whilst maintaining the force on the safety interlock may comprise said user grasping the collar in their other hand and twisting the collar relative to the body whilst holding the safety interlock in the collar release position.

The step of removing the force applied to the safety interlock may comprise throwing the firing mechanism-grenade such that the manually applied force is removed from the safety interlock.

REFERENCE NUMERALS USED IN THE DRAWINGS

Figure 1:
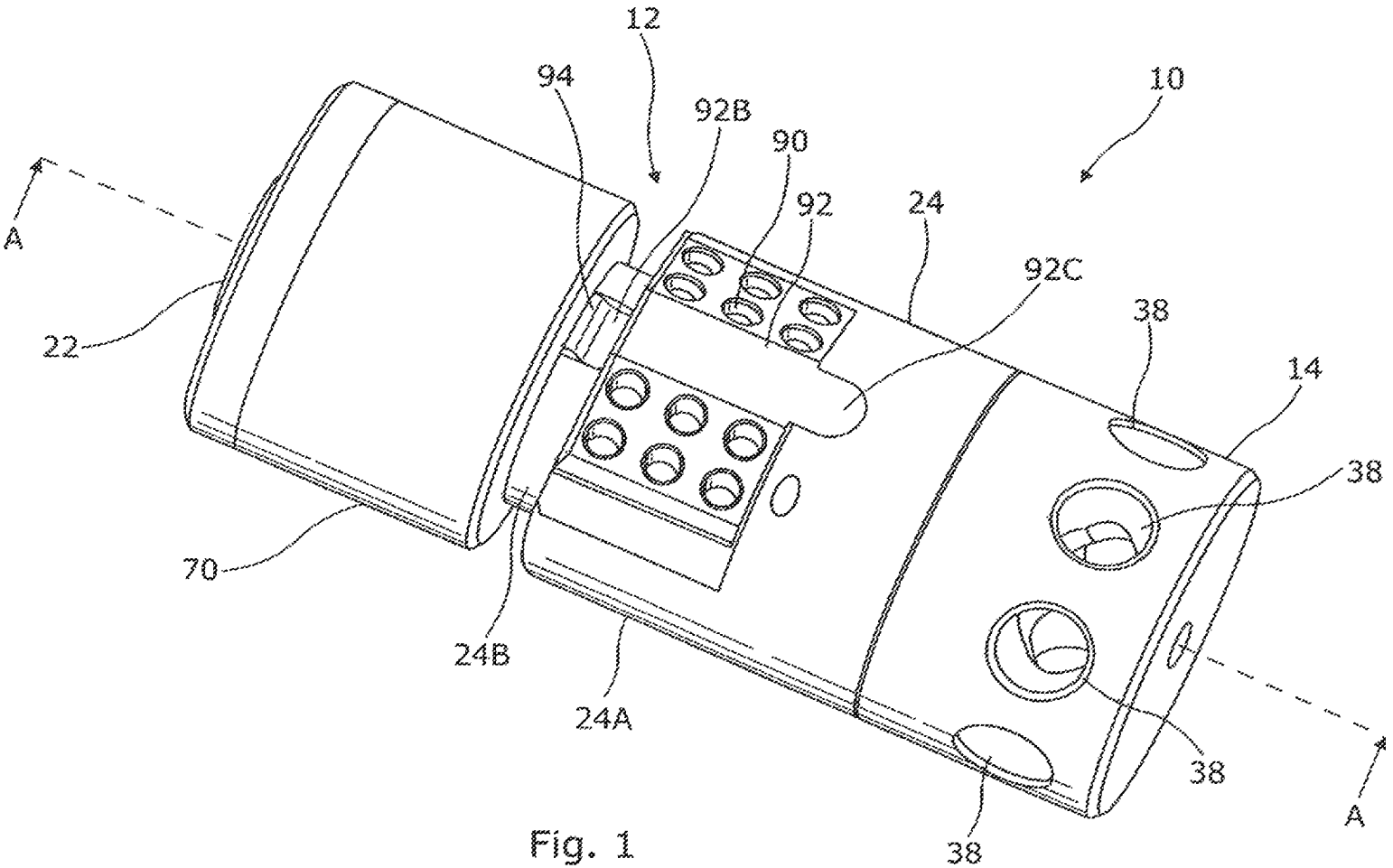
FIG. 1 is a perspective view of an embodiment of a grenade of the present invention.

10 grenade
12 firing mechanism
14 munitions compartment
14A main portion
14B cylindrical boss
16 pyrotechnic cartridge
18 firing system
20 firing pin
22 actuator (inertia toggle)
22A cylindrical head portion
22B inner head portion
22C cylindrical shaft portion
24 cylindrical body
24A larger diameter portion
24B smaller diameter portion
26 through bore
26A large diameter portion
26B small diameter portion
26C radial ledge
28 flange
30 through hole
32 internal screw thread
33 external screw thread
34 cylindrical chamber
36 through bore
38 radial bore
40 end cap
40A radial flange
42 first end
44 spherical formation (ball)
46 larger diameter portion
48 neck region
50 part spherical recess (socket)
52 axial end face
60 firing pin collar
62 radial flange
64 central aperture
66 end face region
68 compression spring
70 cylindrical arming collar
72 cylindrical recess
78 further recess
80 radial flange
82 hole
84 end face region
90 safety interlock
92 button
92A main body portion
94 spring
96 abutment
98 second abutment
102 aperture
104 annular recess
106 aligned bores
108 cylindrical recess
1010 grenade
1012 firing mechanism
1014 munitions compartment

1020 firing pin
1022 actuator toggle
1024A larger diameter portion
1024B smaller diameter portion
1060 firing pin collar
1070 arming collar
1090 safety interlock
1092 button
1092B projection
1096 first abutment
1098 second abutment
2010 grenade
2012 firing mechanism
2014 munitions compartment
2020 firing pin
2020A pin-like portion
2020B piston portion
2022 actuator toggle
2022B inner head portion
2024 body
2026B smaller diameter portion
2040 end cap
2052 planar end face
2070 arming collar
2090 safety interlock
2092 button
2092B projection
2096 first abutment
2098 second abutment
2112 outer surface region
2114 outer surface
2268 spring
3010 grenade
3014 munitions compartment
3018 firing system
3020 firing pin
3020A pin-like portion
3020B piston portion
3022 spring
3024 body
3026B bore
3040 end cap
3070 arming collar
3092 button
3098 second abutment
3116 bore
3118 end closure
3120 spigot
3122 blind bore
4010 grenade
4012 firing mechanism
4020 firing pin
4020B piston portion
4020C main section
4022 spring
4026A bore
4026B intermediate diameter portion
4026C small diameter section
4092 button
4118 end closure
4122 blind bore
4126 seal ring
4130 lands
4132 channel
4134 restricted opening
5010 grenade
5020 firing pin
5020B piston portion
5024 body
5026B reduced diameter portion
5070 arming collar
5090 safety interlock mechanism
5140 interlock members
5142 holes
5148 arcuate groove
5140 locking balls
5150 annular groove
5268 spring

DETAILED DESCRIPTION OF THE INVENTION

In order that the invention may be more clearly understood embodiments thereof will now be described, by way of example only, with reference to the accompanying drawings. The same reference numerals but increased by 1000 in each case will be used in relation to features in common or to features that perform substantially the same function in the following embodiments.

A grenade 10 Incorporating a firing mechanism 12 in accordance with a first embodiment of the present invention is shown in FIGS. 1 to 3D. The grenade 10 is a so-called stun grenade or distraction device and comprises a firing mechanism 12 and a munitions compartment 14 releasably mountable to the firing mechanism. The munitions compartment 14 holds a pyrotechnic cartridge 16 containing a primer charge, a fuze and a deflagrating pyrotechnic charge. The firing mechanism 12 has a firing system 18 including a firing pin 20 and an actuator 22 which is operative to move the firing pin 20 from an initial position in a firing direction so as to strike the primer charge. The primer charge when struck ignites the fuze which in turn ignites the pyrotechnic charge after a set time delay. In the present embodiment, the actuator is in the form of an inertia toggle 22. The firing mechanism 12 includes a generally cylindrical body 24. The outer surface of the body 24 is stepped, having a larger diameter portion 24A at a first end, to which the munitions compartment 14 is mounted, and a smaller diameter portion 24B projecting from the larger diameter portion at the opposite, second end. A generally cylindrical through bore 26 extends through the body 24. The through bore 26 is also stepped, having a large diameter portion 26A which opens at the first end and a small diameter portion 26B which extends from the large diameter portion to the second end of the body 24. The through bore 26 is partially closed at the second end of the body by means of a radial flange 28. The flange 28 has a through hole 30 concentric with the bore 26 but which has a smaller diameter than the small diameter portion 26B of the through bore 26. At least an axial outer end region of the large diameter portion 26A of the bore has an internal screw thread 32. The body 24 may be manufactured from any suitable material but advantageously may be manufactured from aluminum or an aluminum alloy or stainless steel. The munitions compartment 14 is generally cylindrical having a main portion 14A with an outer diameter substantially the same as that of the large diameter portion 24A of the firing mechanism body 24. A smaller diameter cylindrical boss 14B projects in an axial direction centrally from one end of the main portion 14A. The boss 14B has an external screw thread 33 which is configured to engage with the internal thread 30 in the large diameter portion 26A of the through bore in the firing mechanism body 24 to mount the munitions compartment 14 to the firing mechanism 12. The munitions compartment 14 has an axial cylindrical chamber 34 for receiving the pyrotechnic cartridge 16. The chamber 34 opens at the free axial end of the boss 14B but is partially closed at the opposite end. An axial through bore 36 connects the chamber 34 with a number of radial bores 38 in the main portion 14A of the munitions compartment which fluidly connect the axial bore 36 to atmosphere. The though bore 36 continues axially beyond the radial bores 38 to open at the end of the munitions compartment. The cartridge 16 is mounted in the chamber 34 with the primer charge and fuze towards the open end of the chamber at the free end of the boss 14B and the pyrotechnic charge adjacent the partially closed end. When the pyrotechnic charge is ignited, the flash of light, sound and pressure given off passes out through the axial bore 36 and the radial bores 38. The munitions compartment 14 can be unscrewed from the body 24 of the firing mechanism to allow for replacement of the cartridge 16.

An end cap 40 is located in the through bore 26 in the firing mechanism body 24 for guiding the firing pin 20. The end cap 40 is generally cylindrical and is a close sliding fit in the smaller diameter portion of the bore 26B. The end cap has a radial flange 40A at one end which is a close sliding fit in the larger diameter portion 26A of the bore 26. The radial flange 40A is clamped between the boss 14B of the munitions compartment 14 and a radial ledge 26C at the transition between the large and small diameter portions 26A, 26B of the bore 26 to hold the end cap 18 in place. The end cap 40 has an axial through bore at its center, the through bore being concentric with the longitudinal axis X of the firing mechanism body 24 and the firing pin 20.

Figure 2:
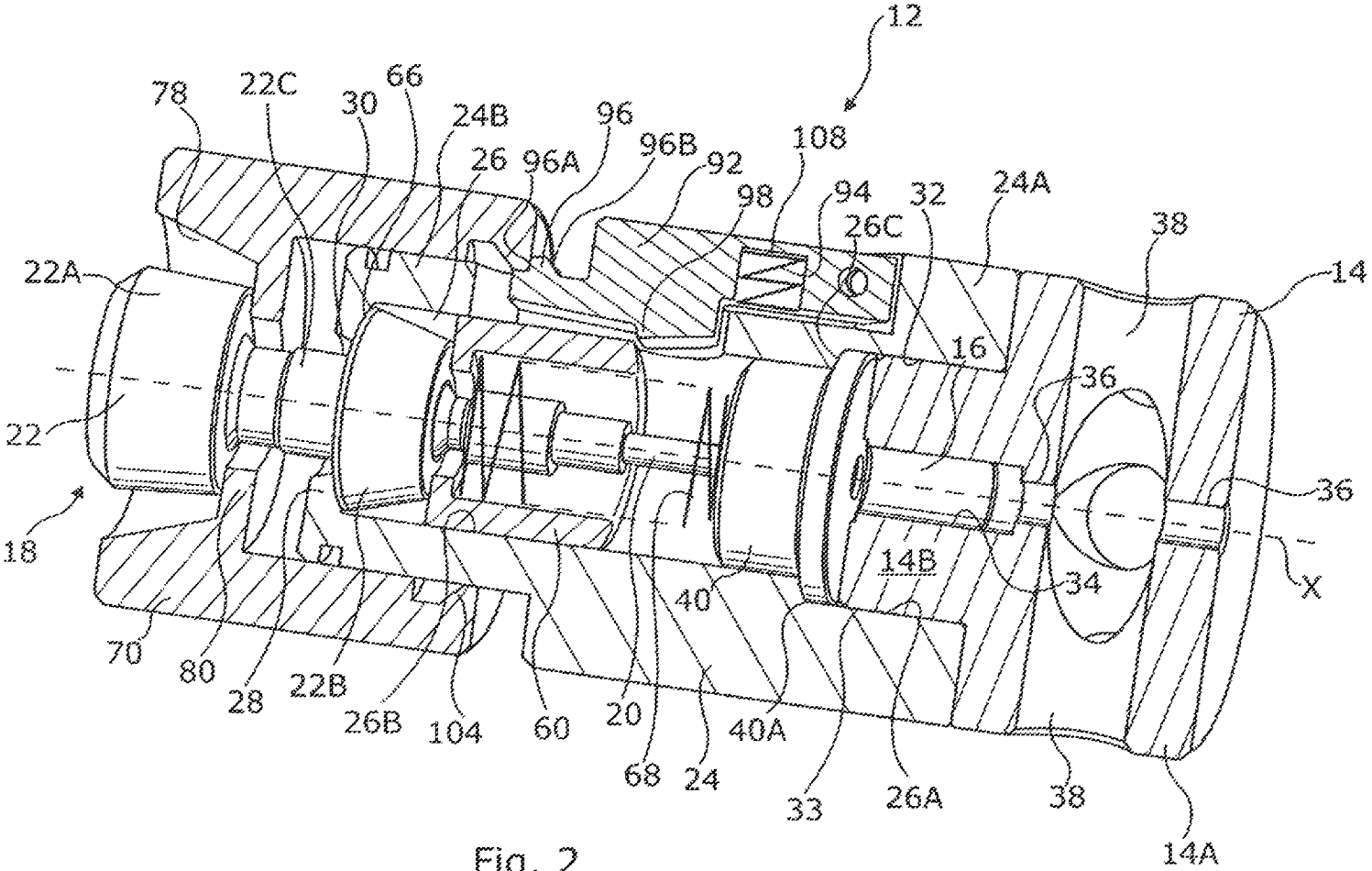
FIG. 2 is a longitudinal cross-sectional view of the embodiment shown in FIG. 1, taken through the line A- A.

The firing pin 20 is mounted predominantly inside the small diameter portion 26B of the through bore 26 in the firing mechanism body 24. A first end 42 of the pin 20 is dimensioned to fit through the bore in the end cap 40 and has a pointed end for contact with the primer charge in the cartridge 16 when the firing pin 20 is moved axially toward the cartridge by the actuator toggle 22. The opposite, second, end of the firing pin has a part spherical formation 44 which forms the ball of a ball and socket connection with the actuator toggle 22. Between the ball 44 and its first end 42, the firing pin has a larger diameter portion 46 which is separated from the ball 38 by a narrower neck region 48. The actuator toggle 22 is rotationally symmetrical about an axis aligned with the longitudinal axis X of the firing mechanism body 24 when the toggle 22 is in an upright position as shown in FIG. 2. The outer surface of the actuator is profiled to define a cylindrical outer head portion 22A and a frusto-conical inner head portion 22B. The head portions are connected by a generally cylindrical shaft portion 22C which has a smaller outer diameter than either of the head portions. The shaft portion 22C may be stepped as shown. The inner head portion 22B is located inside the small diameter portion 26B of the bore 26 in the body 24. A part spherical recess 50 is formed centrally in an inner axial end face 52 of the inner head portion to form a socket which receives the bail 44 on the end of the firing pin 20. The socket 50 and ball 44 are configured so that the bail is held captive in the socket when fully engaged so that the firing pin 20 is mechanically coupled for movement with the toggle in an axial direction of the body 24 but so that the toggle 22 can pivot relative to the firing pin. The shaft portion 22C passes through the hole 30 in the flange 28 at the second end of the body 24 with a sufficient clearance that the actuator toggle is able to tilt relative to the body 24 to a significant degree when the grenade is armed. The actuator toggle 22, especially the outer head portion 22A, has a relatively high mass. The actuator toggle 22 can be made of any suitable material or combinations of material. In one embodiment, the actuator toggle is made of a metal such as stainless steel.

A firing pin collar 60 is mounted about the firing pin 20 inside the body 24 below the inner head portion 22B of the actuator. The firing pin collar 60 is in the form of a cylindrical tube. The end of the collar 60 adjacent the inner head portion 22B is partially closed by means of a radial flange 62 with a central aperture 64. The flange 62 locates about the neck region 48 of the firing pin 20 and is dimensioned to abut the inner axial face 52 of the inner head portion 22B of actuator toggle 22.

The inner head portion 22B also has an annular, axially outer end face region 66 and is dimensioned so that this end face region 66 can be brought into abutment with the inner surface of the radial flange 28 at the second end of the body 24. A helical compression spring 68 is located about the firing pin 20 and operatively engages the main body of the end cap 40 and the radial flange 62 inside the firing pin collar 60 so as to bias the firing pin collar 60 axially away item the end cap 40. This presses collar 60 onto the inner head portion 22B of the actuator toggle 22, which in turn presses the end lace region 66 of the toggle into engagement with the radial flange 28 at the second end of the body 24. Since the firing pin 20 is constrained to move axially with the actuator toggle 22 due to the ball 44 being held captive in the socket 50, this arrangement holds the tiring pin in an initial position from which it can be moved axially in a firing direction towards the munitions compartment 14 by the actuator toggle against the bias of the spring 68 to set off the cartridge 16.

A generally cylindrical arming collar 70 is mounted concentrically about the smaller diameter portion 24B of the firing mechanism body 24. The arming collar 70 has an outer diameter that is substantially the same as the outer diameter of the larger diameter portion 24A of the body 24. The arming collar 70 has cylindrical recess 72 which opens at one axial end. The small diameter portion 24B of the firing mechanism body 24 is received in the recess 72. The inner surface of the side wall defining cylindrical recess 72 and the outer surface of the small diameter portion 24B of the firing mechanism body 24 have corresponding screw threads or similar inter-engaging formations arranged so that the arming collar 70 moves linearly in an axial direction relative to the body 24 when it is rotated about to the body 24.

The arming collar 70 has a further recess 78 at its other end which is separated from the first mentioned cylindrical recess 72 by a radial flange 80 having a central through hole 82. The further recess 78 is frusto-conical in shape and is configured to receive the outer head portion 22A of the actuator 22, with the actuator shaft portion 22C passing through the hole 82 in the radial flange 80 with a clearance. The hole 82 has a smaller diameter than the outer head portion 22B so that the flange 80 can be brought into abutment with an inner axial end face region 84 of the outer head portion 22A.

Figure 3B:
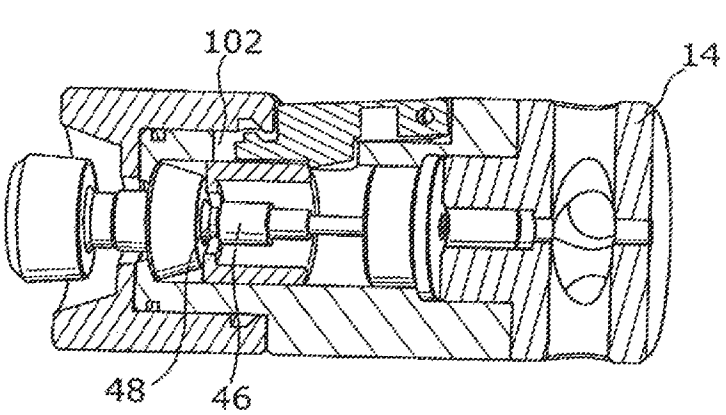
FIGS. 3 A to 3D are a series of longitudinal cross-sectional views similar to that of FIG. 2 illustrating the operational use of the grenade.
Figure 3A:
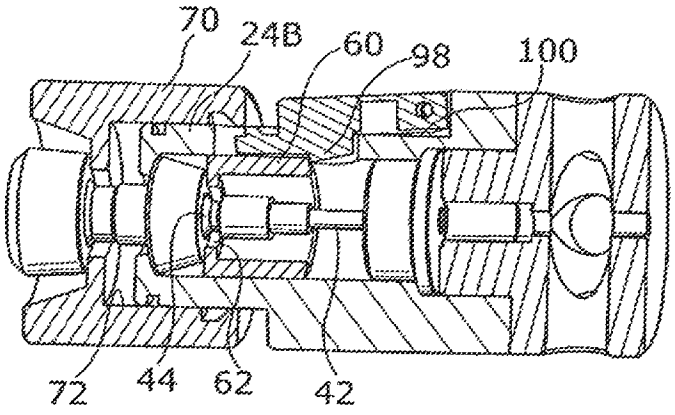
Figure 3D:
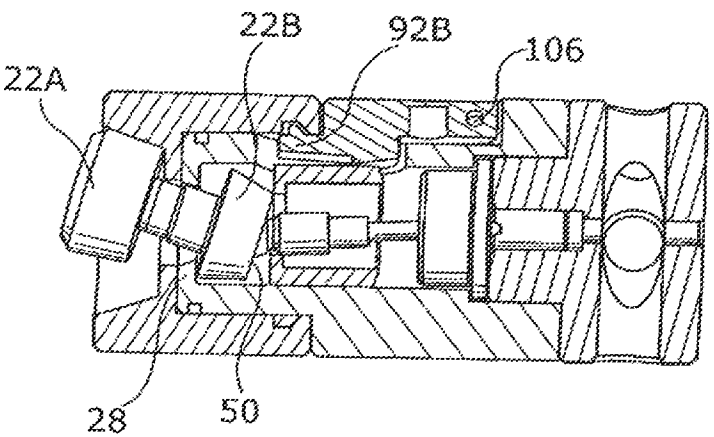
Figure 3C:
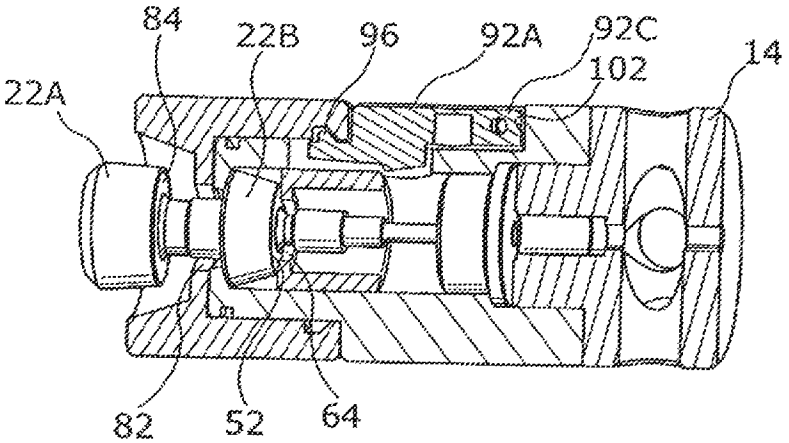

The arming collar 70 can be twisted about the body 24 to move it axially between an unarmed position as illustrated in FIGS. 1 to 3A, and an armed position as illustrated in FIGS. 3B to 3D.

Twisting the arming collar 70 in one rotary direction moves it axially in a direction away from the munitions compartment 14 into the unarmed position in which the arming collar radial flange 80 abuts the outer bead portion 22A of the actuator 22 to hold the inner head portion 22B firmly in contact with the radial flange 28 at the second end of the body 24. In this position, the radial flange 80 of the arming collar 70 is axially spaced from the axial tree end of the small diameter portion 24B of the body 24. When the collar 70 is in the unarmed position, it prevents the actuator toggle 22 from tilting relative to the body 24 or moving axially away from the radial flange 28 and so inhibits actuation of the firing pin 20. Since the firing pin is mechanically coupled to the actuator toggle by the ball and socket joint, the firing pin is prevented from moving axially in the firing direction from its initial position.

Twisting the arming collar 70 in the opposite rotary direction moves the collar 70 axially in a direction towards the munitions compartment 14 to an armed position as illustrated in FIGS. 3B to 3D. In the armed position, the arming collar flange 80 is spaced axially from the outer head portion 22A of the actuator toggle 22, in its initial biased position, and may be in contact with the axial free end of the small diameter portion 24B of the body 24. With the arming collar 70 in the armed position, it no longer engages the toggle to prevent the actuator toggle 22 from tilting relative to the body 24 or moving axially inwardly. In use when the grenade is thrown with the arming collar 70 in the armed position, the actuator toggle 22 will move relative to the body when the grenade hits the ground or some other hard surface. This is due to the inertia of the actuator toggle 22 and in particular the outer head portion 22A which has a relatively high mass. As illustrated in FIG. 3D, the actuator toggle may tilt relative to the body if the grenade hits the ground at a suitable angle. As the actuator toggle 22 tilts, the inner head portion 22B tends to pivot about a point of contact with the flange 28 of the body 24, so that part of the inner head portion 22B moves axially towards the munitions compartment 14 compressing the spring 68 (which is omitted from FIGS. 3A to 3D). This moves the firing pin 20 axially from its initial position in the tiring direction towards the munitions compartment so that it strikes the primer charge in the cartridge 16 to ignite the fuze and the pyrotechnic charge. Alternatively, if the grenade were to hit a surface directly on the end of the munitions compartment 14, the actuator toggle 22 could move axially towards the munitions compartment to activate the tiring pin without tilting.

The arming collar 70 acts as a first safety device which in the unarmed position prevents the grenade 10 from being fired if dropped or thrown. The twist to arm collar system is simple and effective. To operate the twist to arm collar 70, the grenade 10 is grasped in one hand about the larger diameter portion 24A of the body 24 and/or the munitions compartment 14. The collar 70 is grasped in the other hand and moved with a simple twisting action from the unarmed position to the armed position. Unlike lever and pin grenade arming systems, there is no requirement to hold the grenade 10 in any particular orientation and the twist to arm mechanism can be effectively operated even whilst wearing gloves and in adverse conditions.

In accordance with an aspect of the present invention, the grenade 10 has a second safety system in the form of a manually actuated safety interlock 90 which must be operated before the arming collar 70 can be moved from the unarmed position to the armed position and which prevents the firing system of setting off the grenade 10 even when the collar 70 is in the armed position until the safety interlock 90 is released. The safety interlock 90 in the embodiment shown in FIGS. 1 to 3 includes a button 92 which is pivotally mounted to body 24 of the firing mechanism. The button 92 is biased by a spring 94 radially outwardly towards a first collar locking position as shown in FIGS. 1 and 2. The button can be depressed radially inwardly against said bias upon application of a force by a user to a second collar release position as shown in FIGS. 3A and 3B. When the arming collar 70 is in its unarmed position and the button 92 is in the collar locking position, a first abutment 96 on the button 92 engages the arming collar 70 and prevents it being moved axially to the armed position. In order to arm the grenade, the button 92 is manually depressed to the collar release position and held there against the bias force. In this position, the first abutment 96 is moved radially inside the collar so that the collar 70 can be moved to its armed position.

However, when the button 92 is in the collar release position, a second abutment 98 on the button 92 engages the firing pin collar 60 to hold the actuator toggle 22 in contact with the flange 28 in the body 24 and so inhibit actuation of the firing pin 20. In order for the-grenade to be set off, the arming collar 70 is moved to the armed position and the button 92 released so that it is moved by the spring 94 radially outwardly to a firing position as shown in FIG. 3C in which the second abutment 98 is disengaged from the firing pin collar 60. The actuator toggle 22 is now enabled and the grenade can be thrown and set off as described above and illustrated in FIG. 3D. The button 92 has a main body portion 92A which is set in a recess 100 formed in the outer surface of the large diameter portion 24A of the body 24. The outer surface of the main body portion 92A is generally flush with, or just slightly inset from, the outer surfaces of the large diameter portion 24A of the body 24 and the arming collar 70. The main body portion 92A is dimensioned and located so that it can be easily and reliably contacted and depressed by a user using their thumb or fingers when grasping the grenade. The first abutment 96 is provided on projection 92B of the button which extends from the main body portion 92A in a direction towards the arming collar 70 and which is offset radially inwardly from the outer surface of the main body portion 92A. The projection 92B is at least partly received in an aperture 102 formed through the wall of the body 24. The first abutment 96 takes the form of an upstand on the outer surface of the projection 92B which is offset slightly inwardly from the end edge of the projection. The upstand 96 has a generally upright first end face 96A which is directed toward the end of arming collar 70 when in its unarmed position.

As shown in FIG. 2, when the collar 70 is in the unarmed position and the button 92 is in the collar locking position, the inner edge of the arming collar 70 locates on the end of the projection 92B so that the upright end face 96A of the abutment engages the end face of the collar 70 preventing the arming collar from moving axially towards the armed position. When the button 92 is depressed to the collar release position, the projection 928 and the first abutment 96 are moved radially inside the arming collar 70 which can pass over the projection 92B to the armed position. The second abutment 98 takes the form of a projection on the inner surface of the button 92 which passes through the aperture 102 to engage the firing pin collar 60 when the button is depressed to the collar release position.

An annular recess 104 is formed about the inner surface 74 of the arming collar 70. The first abutment 96 is received in the annular recess when the arming collar 70 is in the armed position and the button 92 is released to move radially outwardly as shown in FIG. 3C. The button 92 and recess 104 are configured to enable the button to move radially outwardly to a firing position in which the second abutment 98 is disengaged from the firing pin collar 60 when the collar is In the armed position. In the present embodiment, the second abutment 98 only engages the collar when it is depressed radially inwardly from the collar locking position and so the firing position of the button may be substantially the same as its collar locking position, although this is not essential. A rear face 96B of the first abutment 96 and the opposing surface of the annular recess 104 may be angled so that the arming collar 70 can be moved from the armed position to the unarmed position without having to manually depress the button from its firing position. In this case, the button 92 is automatically depressed as the angled surfaces pass over one another and will move back to the collar locking position automatically once the arming collar reaches its unarmed position.

The button 92 has a hinge portion 92C which extends from the main body 92A in the opposite direction from the projection 92B and is received in an appropriately shaped extension of the button recess 102. A pin is inserted through aligned bores 106 in the hinge portion 92C and the body 24 either side of the hinge portion to pivotally attach the button to the body. The spring 94 is received in a cylindrical recess 108 formed in the inner surface of the hinge portion 92C and engages with an opposing outer surface of the main body 24 at the bottom of the button recess 102.

The arming collar 70 and the safety interlock 90 work in combination to significantly reduce the chances of the grenade 10 being unintentionally fired, especially when being held by a user prior to being thrown. With the arming collar 70 in the unarmed position and the safety interlock in the collar locking position, the actuator toggle 22 is inhibited from actuating the firing pin 20, which is held in its initial position so that the grenade cannot be set-off. The safety interlock 90 prevents the arming collar being unintentionally moved to the armed position. This is the configuration that the grenade 10 would usually be in prior to use and ensures that the grenade is rendered safe even when a loaded munitions compartment 14 is attached to the firing mechanism. When it is intended to deploy the grenade 10, a user grasps the body 24 in one hand and depresses the safety interlock button 92 using their fingers or thumb. This can be done simply and reliably even wearing gloves and under operational conditions. The user holds the safety Interlock button 92 in its depressed position and twits the arming collar 70 to the armed position whilst holding the safety interlock in the collar release position so that the grenade remains safe whilst it is being held. It is intended that the user will hold the safety interlock button 92 in its depressed collar release position at all times whilst the collar is in its armed position prior to throwing the grenade. This prevents the grenade 10 from being unintentionally set off, for example by the user hitting the grenade against a surface or another person whilst in the act of throwing or in preparation for throwing. The safety interlock button 92 is only released to move to the firing position when the grenade is thrown with the arming collar in the armed position. A further advantage of the system is that the arming collar 70 can be safely returned to the unarmed position if a decision is made not to deploy the grenade after initial arming. In most cases, the arming collar should be returned to the unarmed position before the safety interlock is released. However, in this embodiment where the actuator is an inertia toggle, the collar could be returned to the armed position after the safety interlock has been released provided that the grenade is not thrown. Nevertheless, the safety interlock would generally be depressed to the collar release position to render grenade safe again before the arming collar is moved back to the unarmed position.

Whilst the grenade 10 as described above comprises a munitions compartment which holds a cartridge 16 having deflagrating pyrotechnic charge, the firing mechanism 12 incorporating an arming collar 70 and safety interlock 90 can be adapted for use with other types of munitions including explosive charges which detonate and which may be located in a housing designed to fragment in use. In a further alternative, the munitions compartment 14 may be adapted to hold only a primer charge to be set off by the firing pin 20. Such an arrangement may be used as a training grenade for example. These alternative munitions arrangements can be adopted in any of the embodiments disclosed in this application.

Figure 4:
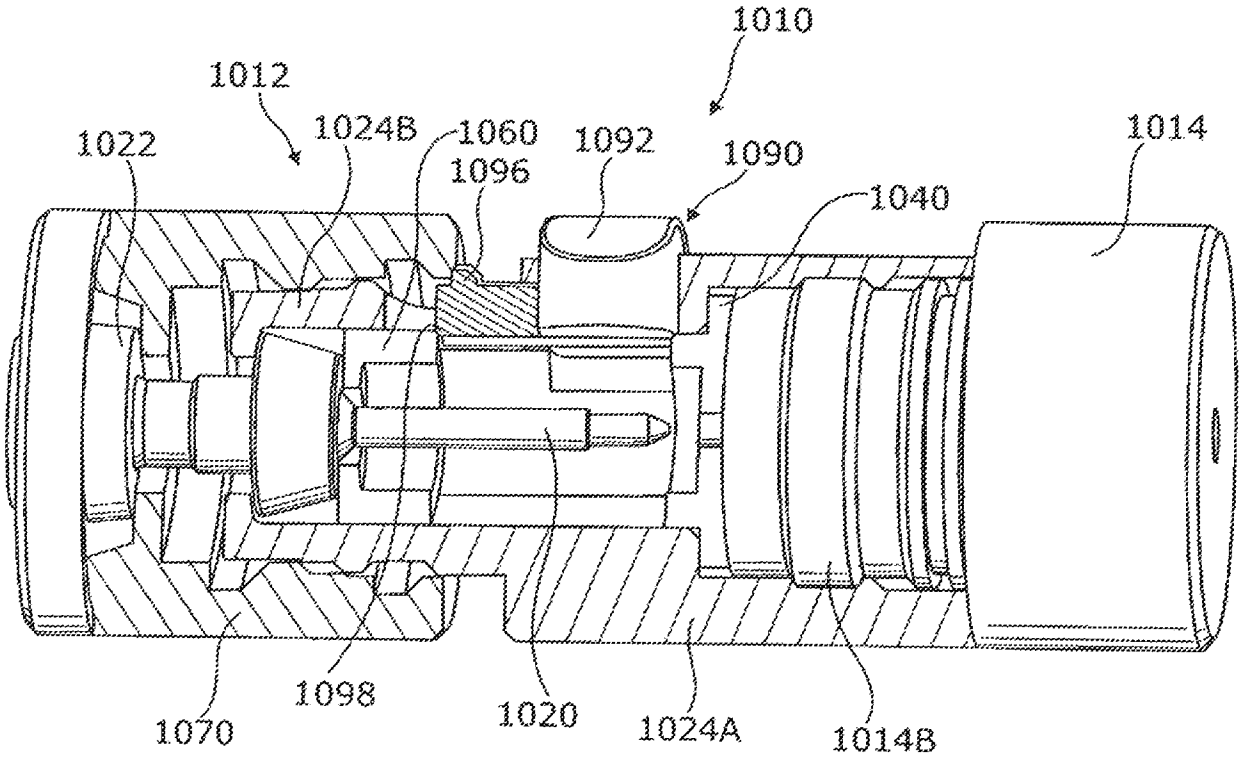
FIG. 4 is a longitudinal cross-sectional view of a further embodiment of a grenade of the present invention.

FIG. 4 is a view similar to that of FIG. 2 but illustrating a further embodiment of a grenade 1010 incorporating a firing mechanism 1012 of the present invention. The grenade 1010 is very similar to the first embodiment and only significant differences between this embodiment and the first will be described in detail. For a general understanding of the construction and operation of the grenade 1010 the reader should refer to the description of the previous embodiment taking in to account that components in common with those of the first embodiment have been given the same reference numerals but increased by 1000.

In the embodiment shown in FIG. 4, the safety interlock 1090 comprises a button 1092 which is slidably mounted to the body of the firing mechanism 1012 for movement between its collar locking, collar release and firing positions rather than pivotally mounted as in the first embodiment. As with the first embodiment, the button 1092 is resiliency biased in a radially outward direction, to the collar locking and firing positions (which may be the same) by means of a spring (not shown). The button 1092 can be slidably mounted in the body in any suitable manner but otherwise operates in a similar manner to the button 92 in the first embodiment. The button 1092 has a first abutment 1096 which engages the arming collar 1070 when the arming collar is in the unarmed position and the button 1092 is in the collar locking position to prevent the arming collar 1070 from being moved to the armed position. A second abutment 1098, which in this embodiment, is on the end of the projection 1092B, engages with a shortened firing pin collar 1060 to inhibit operation, of the actuator toggle 1022 when the button 1092 is depressed to the collar release position to allow the arming collar 1070 to be moved to the armed position. The button 1092 is moved radially outwardly to a firing position in which the second abutment 1098 is disengaged from the firing pin collar 1060 by the spring when the button is released whilst the arming collar is in the armed position. Whilst the munitions compartment 1014 as illustrated in FIG. 4 does not have radial bores, the munitions compartment 1014 could be configured in the same manner as that in the first embodiment or in accordance with any of the alternative arrangements discussed above.

FIGS. 5A to 5D illustrate a further embodiment of a grenade 2010 having a firing mechanism 2012 in accordance with the invention. The grenade 2010 is similar to the previous embodiment shown in FIG. 4 and has a safety-interlock 2090 comprising a button 2092 which is slidably mounted to the body 2024 of the firing mechanism. It will be appreciated that FIGS. 5A to 5D are somewhat schematic representations and that the munitions compartment 2014 in particular is not shown in detail. The reader should refer to the description of the earlier embodiments for an overall understanding of the construction and operation of the grenade 2010.

The firing mechanism 2012 in this embodiment differs from the previous embodiments in that the firing pin 2020 is not mechanically coupled to the toggle actuator 2022 by means of a ball and socket joint. Rather, in this embodiment, the firing pin 2020 has pin-like portion 2020A projecting from a cylindrical piston portion 2020B which is a sliding fit inside the reduced diameter portion 2026B of the bore in the firing mechanism body 2024. The piston portion 2020B of the firing pin has a planar end face 2110 which abuts a planer end face 2052 of the inner head portion 2022B of the toggle actuator. A compression spring 2268 is operative between the end cap 2040 and the piston portion 2020B of the firing pin to bias the firing pin into engagement with the toggle actuator. The spring 2268 is selected to apply sufficient force to maintain the firing pin 2020 in contact with, the toggle 2022 so that the pin 2020 will not move to strike the primer charge during normal handling of the grenade. However, the force applied by the spring 2268 can be overcome by the toggle actuator 2022 to move the firing pin to set off the grenade when the grenade is thrown as is described in relation to the previous embodiments.

Figure 5A:
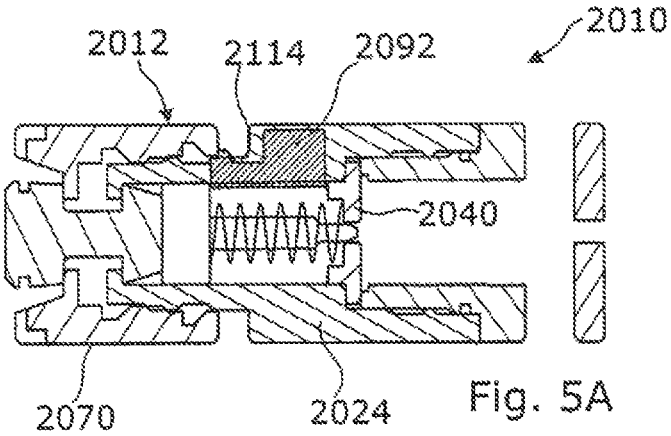
FIGS. 5A to 5D are a series of views similar to FIGS. 3A to 3D but illustrating an alternative embodiment of a grenade in accordance with the invention.

As an additional safety feature, in this embodiment the second abutment 2098 of safety interlock button 2092 engages the piston portion 2020B of the tiring pin when the safety interlock button 2092 is in the collar locking position as well as the collar release position and at all positions in-between. This acts as an additional safety measure to prevent the firing pin accidentally separating from the toggle 2022 and moving in the firing direction to strike the primer charge, say in the event the grenade is dropped or knocked whilst the collar is in the unarmed position. In order to disengage the safety interlock button 2092 from the firing pin 2020, it is moved to a firing position which is radially outside or beyond the collar locking position in the first direction as illustrated in FIG. 5D. The button 2092 is prevented from moving past the collar locking position to the firing position when the arming collar 2070 is in its unarmed position due engagement of the arming collar with an outer surface region 2112 of the distal end of the button projection 2092B as shown in FIG. 5A.

Figure 5B:
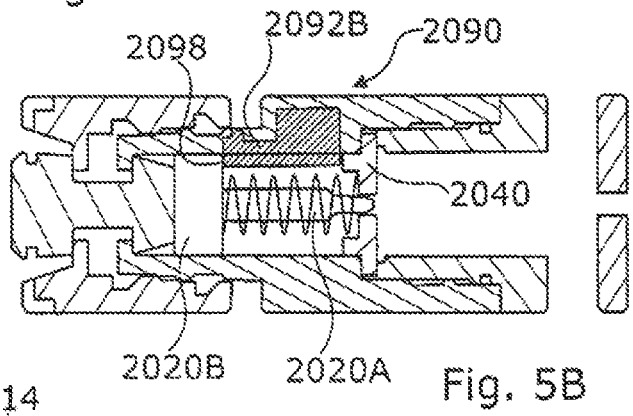
Figure 5C:
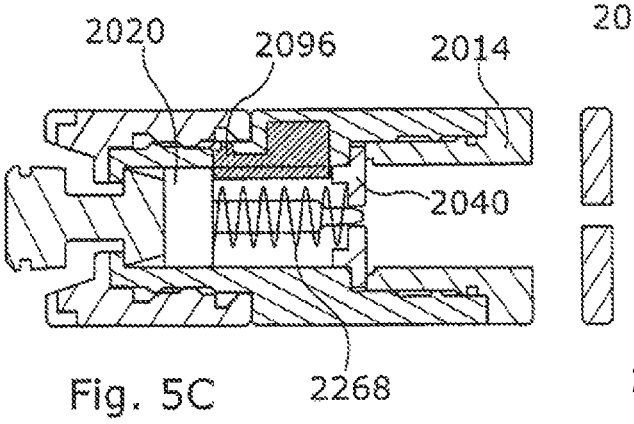
Figure 5D:
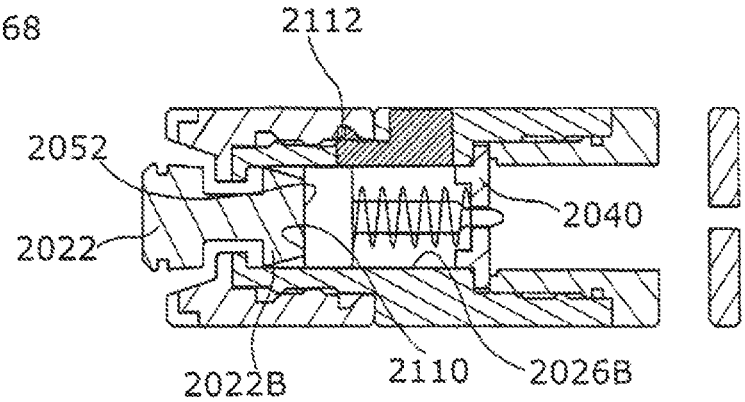

In order to arm the grenade, the safety interlock button 2092 is depressed into its collar release position as shown in FIG. 5B and the arming collar 2070 twisted to move it to the armed position. At this stage, the safety interlock button 2092 remains in contact with the firing pin so that the grenade is rendered safe. If the button 2092 is released with the arming collar 2070 in the armed position it is able to move radially outwardly to the firing position as shown in FIG. 5D due to the configuration of the button and the arming collar. In the present embodiment, the outer surface 2114 of the projection 2092B between the first abutment 2096 and the main body portion 2092A is recessed below the outer surface 2112 at the end of the projection to allow for the additional radially outward movement of the button to the firing position. With the collar in the armed position and the safety interlock button released, the toggle actuator 2022 is able to move the firing pin 2020 to set off the grenade in the usual manner as illustrated in FIG. 5D, which shows the actuator toggle 2022 moving axially towards the munitions compartment. However, as described above in relation to FIG. 3D, the actuator toggle 2022 may tilt relative to the body 2024 of the firing mechanism to activate the firing pin when it lands after being thrown. As previously described, it is intended that the safety interlock button 2092 would only be released with the arming collar in the armed position when the grenade is actively deployed.

Figure 6:
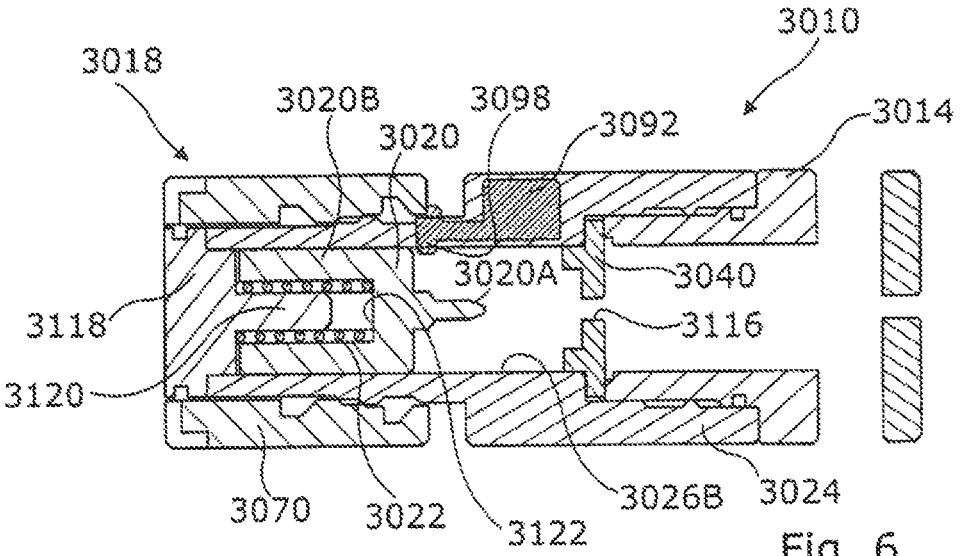
FIG. 6 is a longitudinal cross-sectional view of a still further embodiment of a grenade of the present invention.

FIG. 6 illustrates a still further embodiment of a grenade 3010 having a firing mechanism in accordance with the invention. The grenade 3010 is similar to the grenade 2010 of the previous embodiment in having a safety interlock button which engages the firing pin 3020 when it is in the collar locking position to prevent the firing pin moving from its initial position towards the munitions compartment 2014. In order to fire the grenade, the safety interlock button must be released into a firing position radially outboard of the collar locking position. This is only possible when the arming collar 3070 is in the armed position as described above in relation to the previous embodiment.

The grenade 3010 in this embodiment however has an alternative actuator arrangement for the firing pin 3020. Rather than an inertial actuator toggle, the firing system 3018 in this embodiment uses a compression spring 3022 to bias the firing pin 3020 in the firing direction towards the munitions compartment 3014. The firing pin 3020 has a pin-like portion 3020A which projects from a cylindrical piston portion 3020B that is a sliding fit inside the reduced diameter portion 3026B of the bore in the firing mechanism body 3024. The pin-like portion is dimensioned to fit through a bore 3116 in the end cap 3040 to strike the primer charge (not shown) in the munitions compartment 3014 when the firing pin is propelled in the firing direction by the spring 3022. The firing mechanism body 3024 is closed at the end opposite from the munitions compartment 3014 by an end closure 3118 which may be coupled with the body by means of a screw thread or any other suitable arrangement. The end closure 3118 has a central, generally cylindrical spigot 3120 which projects inside the bore 3026B. The piston portion 3120 of the firing pin has a blind bore 3122 with a larger diameter than the spigot in which the spigot is concentrically received when the firing pin is in its initial position as shown. The spring 3022 is located inside the bore 3122 about the spigot 3120 and is compressed between the closed end of the bore 3122 and the end closure 3118 when the firing pin is in its initial position to apply a force to the firing pin in the firing direction.

The firing pin 3020 is held in its initial position against the bias force of the spring 3022 by engagement of the second abutment 3098 on the interlock button 3092 with the piston portion 3020B of the firing pin when the button is in its collar locking position and at all positions radially inboard of the collar locking position. The safety interlock button 3092 is prevented from moving radially outwardly from the collar locking position to the firing position to release the firing pin by engagement of the arming collar 3070 with interlock button when the arming collar is in its unarmed position in a manner similar to the previous embodiment. The firing mechanism is initially set with the firing pin 3020 in its initial position, the arming collar 3070 in its unarmed position and the safety interlock button 3092 in the collar locking position, where it is operative to bold the firing pin in the initial position against the bias of the spring 3022. A loaded munitions compartment 3014 can then be safely attached to the firing mechanism 3012. To fire the grenade, the safety interlock button 3092 is depressed to the collar release position and the-arming collar 3070 twisted to move it to the armed position. The safety interlock button 3092 is held in its depressed collar release position where it is still operative to hold the firing pin in its initial position so that the grenade remains safe. The grenade can now be thrown, releasing the safety interlock button 3092 which is biased radially outwardly to the firing position releasing the firing pin 3020 to move to strike the primer charge under the influence of the spring 3022.

In this embodiment, the arming collar 3070 does not directly act on the actuator 3022 to inhibit its operation but is used to prevent the safety interlock button 3092 from disengaging the tiring pin when the collar is in the unarmed position so that the grenade cannot be-inadvertently fired.

Figure 7A:
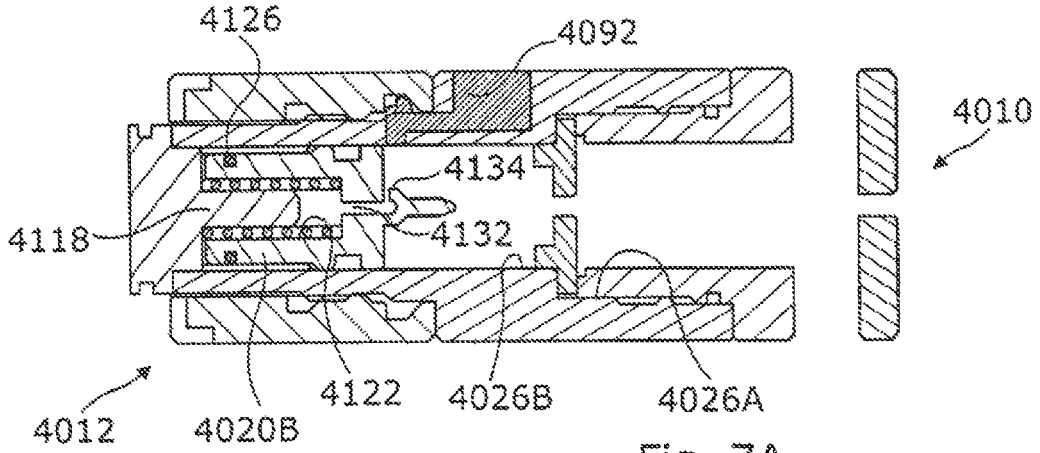
FIGS. 7A and 7B are a series of longitudinal cross-sectional views of another embodiment of a grenade in accordance with the invention illustrating movement of the firing pin from an initial position to a fired position.
Figure 7B:
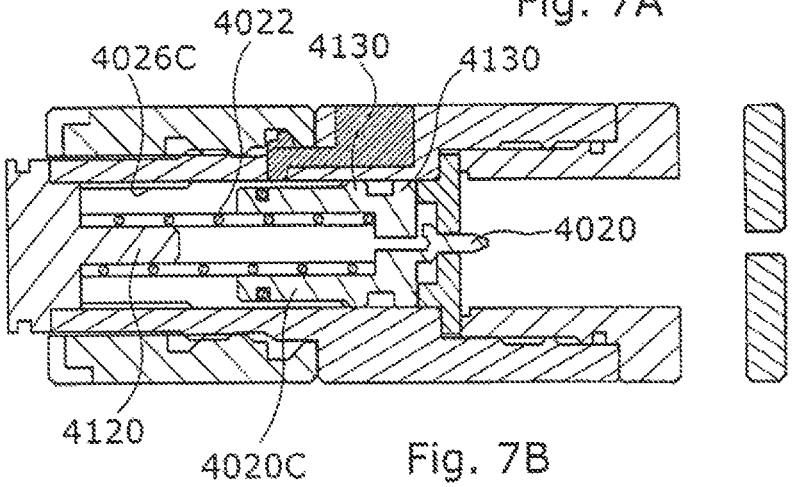

FIGS. 7A and 7B illustrate a further embodiment of a grenade 4010 incorporating a firing mechanism 4012 in accordance with the invention. The grenade 4010 is substantially the same as the previous embodiment 3010 but is modified to incorporate a fluid damper arrangement for restricting the rate of movement of the firing pin 4020 over an initial range of movement from its initial position towards the munitions compartment.

The bore 4026 in the firing mechanism body includes an additional step so as to have a large diameter portion 4026A to which the munitions compartment is mounted, an intermediate diameter portion 4026B and small diameter section 4026C at is end distal from the munitions compartment. The spigot 4120 on the end closure 4118 projects into the small diameter section 4026C of the bore. The piston portion 4020B of the firing pin has a main section 4020C which is a close sliding fit in the small diameter section 4026C whilst the firing pin is in its initial position and for an initial range of movement in the firing direction. The piston portion has lands 4130 which are a sliding fit in the intermediate diameter portion 40268 of the bore. An elastomeric seal ring 4126 is located in a groove on outside of the main portion 3020C of the piston portion to engage with the reduced diameter section 4026C. The seal ring 4126 prevents air from passing between the piston portion and the surface of the bore to enter the bore 4122 in the piston portion. The bore 4122 in the piston proton is not fully blind but has a channel 4132 with a restricted opening 4134 through which air can enter the bore 4122. In this embodiment, the bore 4122 in the piston portion 4020B of the firing pin and the spigot 4120 define between them a chamber which increases in volume as the firing pin moves from its initial position in the firing direction towards the munitions compartment.

In use, the grenade 4010 is set up and armed as described above in relation to the previous embodiment. When the grenade is thrown and the safety interlock button 4092 is released, it is moved to the firing position, and the actuator spring 4122 biases the firing pin 4020 in the firing direction towards the munitions compartment. During an initial range of movement of the firing pin during which the main section 4020C of the piston portion is engaged in the small diameter section 4026C of the bore In the firing mechanism body, the chamber defined between the spigot 4120 and the bore 4122 in the piston portion increases in volume. During this initial, range of movement, air can only be drawn into the chamber through the restricted opening 4134 to the channel 4132. The opening 4134 is arranged to limit the amount of air entering the chamber so that a partial vacuum is created in the chamber. The arrangement is configured so that the partial vacuum restricts the rate at which the firing pin 4020 is moved by the spring but does not prevent the firing pin from moving completely. Eventually, the main section 4020C of the piston portion emerges from the further reduced diameter section 4026C of the bore in the firing mechanism body and the spigot 4120 disengages from the bore 4122 in the piston portion of the tiring pin and the damping effect is removed so that the rate of movement of the firing pin is then determined primarily by the actuator spring 4022, ignoring Motional forces and air resistance of the pin. During this later range of movement, the tiring pin is guided for movement by the lands 4130 which are sliding fit in the intermediate diameter portion 4026B of the bore in the firing mechanism body. The actuating spring 4022 and the damping arrangement can be calibrated to regulate the rate of movement of the firing pin as desired.

Figure 8A:
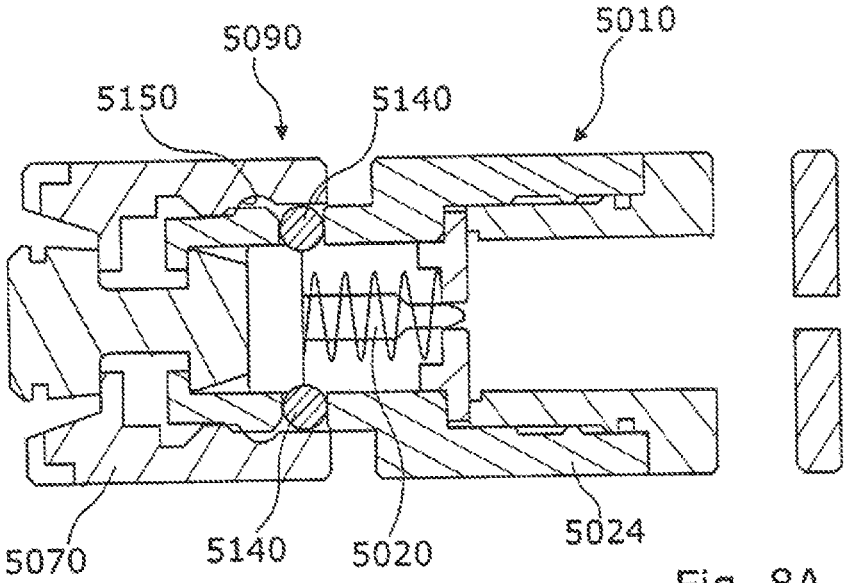
FIGS. 8A to 8C are series of longitudinal cross-sectional views of an embodiment of a grenade in accordance with an aspect of the invention.
Figure 8B:
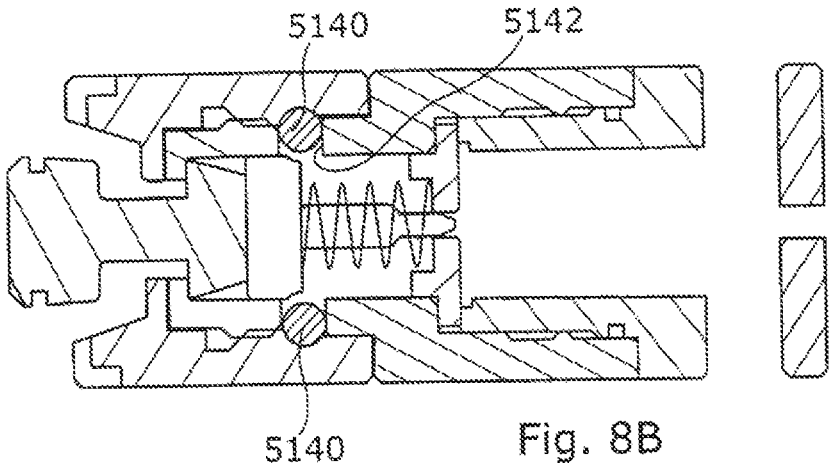
Figure 8C:
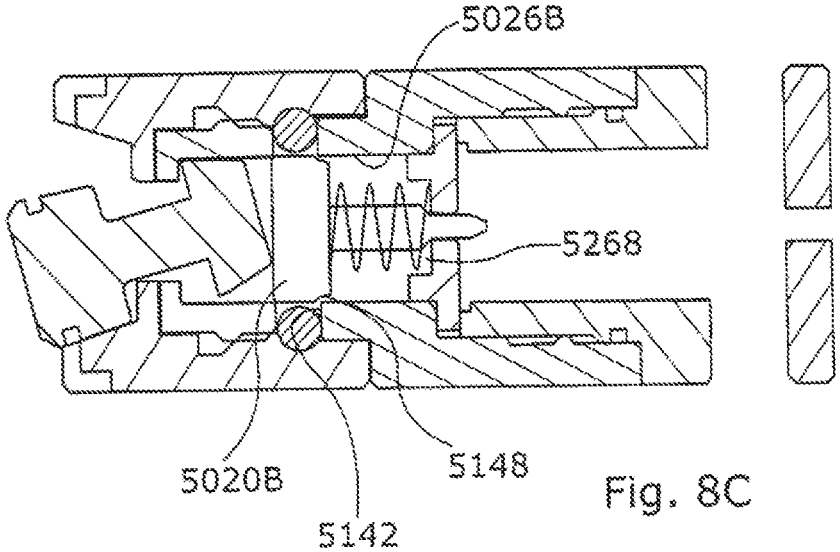

FIGS. 8A to 8C show a further embodiment of a grenade 5010 in accordance with an aspect of the Invention. The grenade 5010 in accordance with this embodiment is a modification of the grenade 2010 as described above in relation to FIGS. 5A to 5D and only the differences will be described. For a general understanding of the construction and operation of the grenade 5010, the reader should refer to the description of the grenade 2010 taking in to account that components in common with that embodiment have been given the same reference numerals but increased by 3000.

Unlike the grenade 2010, the grenade 5010 in accordance with this final embodiment does not have a manually depressible safety interlock button. Rather, the grenade 5010 has an alternative safety interlock mechanism 5090 which is operative to ensure that the firing pin 5020 is mechanically locked in its initial position relative to the body 5024 when the arming collar 5070 is in the unarmed position. The alternative safety interlock mechanism 5090 in this embodiment comprises a number of interlock members 5140 movably located in through holes 5142 in the side wall of the body 5024. The interlock members 5140 are dimensioned and arranged so that when the arming collar 5070 is in its unarmed position, as shown in FIG. 8A, they are held in a locked position in which an inner portion of each interlock member 5140 projects into the reduced diameter portion 5026B of the bore in the firing mechanism body 5024 to engage with the cylindrical piston portion 5020B of the firing pin in its initial position. This prevents the firing pin from moving in the firing direction relative to the body.

The inner surface of the arming collar is profiled so that the interlock members 5140 are prevented from being moved radially outwardly from the locked position by an inner surface region of the collar when it is in the unarmed position but are permitted to move radially outwardly to release the firing pin when the collar is in the aimed position. In the present embodiment, the interlock members 5140 are in the form of locking bails, each of which is a sliding fit in a though hole in the body. The drawings show two locking balls but there may be three or more. Inner portions of the balls 5140 engage with an arcuate groove 5148 at the outer diameter of the piston portion 5020B of the firing pin when the pin is in its initial position and the locking balls are in their locked position. An annular groove 5150 formed in the inner surface of the arming collar aligns with the locking balls 5140 when the arming collar is in the armed position only. Outer portions of the locking balls are able to enter the groove 5150 to enable the locking balls to be moved radially outwardly relative to the longitudinal axis of the grenade so that their inner portions no longer project into the bore 5026B, allowing the piston portion 5020B of the firing pin to slide freely along the bore when the collar is in the armed position. The arcuate groove 5148 is shaped so that movement of the firing pin in the firing direction caused by the toggle actuator when the armed grenade is thrown will push the locking balls 5140 radially outwardly to allow the firing pin 5020 to advance in the firing direction to detonate the grenade.

The alternative safety interlock mechanism 5090 ensures that the firing pin 5020 cannot be accidentally moved from its initial position to set off the grenade when the arming collar is in the unarmed position despite there being no mechanical interconnection between the firing pin and the actuator toggle. The safety interlock mechanism 5090 acts as a back up to the spring 5268 to prevent separation of the firing pin from the toggle actuator in the event the grenade is accidentally dropped or otherwise subjected to a sharp force whilst the collar is in the unarmed position.

The above embodiments are described by way of example only. Many variations are possible, without departing from the scope of the invention as defined in the appended claims. For example, in some of the described embodiments the safety interlock comprises a button which is depressed for movement from the collar locking to the collar release positions. Whilst this is a particularly advantageous arrangement, it is within the scope of the invention for the safety interlock to be moved in alternative directions. The safety interlock might, for example, comprise a button or other structure which is moved circumferentially about the axis of the firing mechanism body between collar locking, collar release and firing positions.

Having described my invention, I claim:

1. A firing mechanism for a grenade comprising:

a body containing a firing system including a firing pin and an actuator mechanism adapted to actuate the firing pin, the actuator having an unarmed position and an armed position;

an arming collar mounted to the body restricting movement of the actuator mechanism from the unarmed position and to the armed position, the arming collar having an actuator locking position and an actuator release position; and a safety interlock mounted to the body and securing the firing pin, the safety interlock having a collar locking position locking the arming collar in the actuator locking position, a collar release position releasing the arming collar to the actuator release position and a firing pin release position releasing the firing pin, the safety interlock being biased by a safety interlock bias mechanism in a first direction towards the collar locking and firing pin release positions and away from the collar release position;

the firing mechanism having a first position with the collar in the actuator locking position and the safety interlock in the collar locking position, the first position inhibiting actuation of the firing pin and inhibiting movement of the collar to the collar armed position;

the firing mechanism having a second position with the safety interlock in the collar release position, the second position allowing the collar to move between the unarmed and armed positions and while inhibiting actuation of the firing pin;

the firing mechanism having a third position with the collar is in the armed position and the safety interlock is in the firing pin release position, the third position enabling actuation of the firing pin.

2. A firing mechanism as claimed in claim 1, in which the collar locking position and the firing pin release position of the safety interlock are the same and the arming collar is operative to inhibit actuation of the firing pin when in the unarmed position.

3. A firing mechanism as claimed in claim 1, in which the collar locking position and the firing position of the safety interlock are different, the safety interlock being operative to inhibit actuation of the firing pin except when in said firing position, the arming collar preventing the safety interlock from being moved to said firing position when in said unarmed position but allowing movement of the safety interlock to said firing position when in said armed position.

4. A firing mechanism as claimed in claim 3, in which the safety interlock must be moved in the first direction beyond said collar locking position from said collar release position to reach said firing position.

5. A firing mechanism as claimed in claim 1, in which the safety interlock is mounted to the body so as to be manually depressed to said collar release position against the bias force of the safety interlock bias mechanism.

6. A firing mechanism as claimed in claim 5, in which the safety interlock comprises a button slidably or pivotally mounted to the body.

7. A firing mechanism as claimed in claim 1, in which the actuator mechanism comprises an inertia toggle movably mounted to the body to actuate the firing pin.

8. A firing mechanism as claimed in claim 1, in which the actuator mechanism comprises a firing pin biasing mechanism operative to move the firing pin relative to the body from an initial position in a firing direction.

9. A firing mechanism as claimed in claim 8, in which the firing pin biasing mechanism comprises a spring for urging the pin in the firing direction from said initial position.

10. A firing mechanism as claimed in claim 8, in which the actuator comprises a damping arrangement for regulating movement of the firing pin.

11. A firing mechanism as claimed in claim 10, in which the damping arrangement comprises a fluid damper operative to restrict the rate of movement of the firing pin in the firing direction from said initial position over at least a part of a range of movement of the firing pin.

12. A firing mechanism as claimed in claim 11, the damping arrangement comprising a chamber defined between the firing pin and one of the body and a component fixed relative to the body, which chamber increases in volume as the firing pin moves in the firing direction from said initial position over said at least part of its range of movement, the chamber having a restricted fluid inlet through which air is able to enter the chamber as the volume of the chamber increases, the arrangement being configured such that, over said at least a part of the range of movement of the firing pin, a partial vacuum is generated in the chamber.

13. A firing mechanism as claimed in claim 1, in which the collar and the safety interlock engage with one another when the collar is in said unarmed position and the safety interlock is in said collar locking position to prevent the collar moving to said armed position.

14. A firing mechanism as claimed in claim 7, in which the collar engages the toggle when the collar is in said unarmed position to inhibit movement of the toggle relative to the firing mechanism body to in a direction to actuate the firing pin.

15. A firing mechanism as claimed in claim 1, in which the safety interlock engages with a component of the firing mechanism to inhibit actuation of the firing pin at least when the safety interlock is in the collar released position, the safety interlock being disengaged from said component when in the firing position.

16. A firing mechanism as claimed in claim 15, in which the safety interlock engages with a component of the firing mechanism to inhibit actuation of the firing pin over its range of movement at and between the collar locking position and the collar release position, the safety interlock being movable in a first direction beyond the collar locking position to the firing pin release position.

17. A firing mechanism as claimed in claim 16, in which the arming collar engages the safety interlock to prevent it from moving beyond the collar locking position to the firing pin release position when the arming collar is in the unarmed position.

18. A firing mechanism as claimed in claim 15, in which the component of the firing mechanism engaged by the safety interlock is one of said firing pin and a component operatively connected with the firing pin.

19. A firing mechanism as claimed in claim 18, in which the firing pin is part of a firing pin assembly and the safety interlock engages with any part of the firing pin assembly to inhibit actuation of the firing pin.

20. A firing mechanism for a grenade comprising:

a body containing a firing system including a firing pin and a toggle actuator mechanism for moving the firing pin in a firing direction from an initial position, the body having a longitudinal axis;

a safety system including an arming collar and a safety interlock button, the arming collar being mounted to the body by inter-engaging formations arranged such that rotation of the collar about the longitudinal axis of the body causes the collar to move linearly relative to the body in the direction of said longitudinal axis between an unarmed position and an armed position, the safety interlock button being mounted to the body for movement in a direction generally perpendicular to the longitudinal axis of the body between a collar release position, a collar locking position, and a firing position, the button being biased outwardly towards the collar locking and firing positions from the collar release position;

wherein the firing mechanism is configured such that:

when the collar is in said unarmed position and the safety interlock is in said collar locking position, the collar engages with the actuator toggle to prevent the toggle from actuating the firing pin and the safety interlock button engages the arming collar to prevent it being moved to the armed position;

when the safety interlock button is in said collar release position it is disengaged from the arming collar to permit the arming collar to be moved from the unarmed position to the armed position and is engaged with a component of the firing mechanism to prevent firing pin being moved in the firing direction;

when the collar is in the armed position, the safety interlock button is able to be moved by the bias force to the firing position in which it is disengaged from said component of the firing mechanism to enable actuation of the firing pin by the toggle actuator.

21. A firing mechanism as claimed in claim 20, in which the collar locking position and the firing position of the safety interlock button are substantially the same.

22. A firing mechanism as claimed in 20, in which the safety interlock button also engages said component of the firing mechanism to prevent the firing pin being moved in the firing direction when in the collar release position, the safety interlock button disengaging said component of the firing mechanism only when moved to a firing position outside of the collar locking position, the arming collar engaging the safety interlock button when in said unarmed position to prevent the safety interlock button being moved beyond the collar locking position to the firing position.

23. A firing mechanism for a grenade comprising:

a body containing a firing system including a firing pin and an actuator spring for biasing the firing pin in a firing direction from an initial position, the body having a longitudinal axis;

a safety system including an arming collar and a safety interlock button;

the arming collar being mounted to the body by inter-engaging formations arranged such that rotation of the collar about the longitudinal axis of the body causes the collar to move linearly relative to the body in the direction of said longitudinal axis between an unarmed position and an armed position;

the safety interlock button being mounted to the body for radial movement in a direction generally perpendicular to the longitudinal axis of the body between a collar release position, a collar locking position and a firing position, said firing position being outside of said collar locking position and the button being biased outwardly towards the collar locking and firing positions from the collar release position;

the safety interlock button engaging with one of the firing pin and a component fixed relative to the firing pin to prevent the firing pin being moved in said firing direction from said initial position when in said collar locking position and said collar release position and at all positions in between, the safety interlock button being disengaged from said one of the firing pin and a component fixed relative to the firing pin to permit movement of the firing pin in the firing direction when in said firing position;

wherein the firing mechanism is configured such that:

the safety interlock button is manually depressible inwardly from said collar locking position to said collar release position against the bias;

when the collar is in said unarmed position and the safety interlock is in said collar locking position, the safety interlock button engages the arming collar to prevent the arming collar being moved to the armed position and the arming collar engages the safety interlock button to prevent the safety interlock button being moved to the firing position;

when the safety interlock button is in said collar release position it is disengaged from the arming collar to permit the arming collar to be moved from the unarmed position to the armed position;

when the arming collar is in the armed position, the safety interlock button is able to be moved by the bias force to the firing position.

24. A firing mechanism for a grenade comprising:

a body containing a firing system including a firing pin and an actuator mechanism for moving the firing pin in a firing direction from an initial position, the body having a longitudinal axis;

a safety system including an aiming collar and a safety interlock, the arming collar rotationally mounted to an outer surface of the body by inter-engaging formation, the arming collar having a first rotational position about the longitudinal axis of the body and a second rotational position about the longitudinal axis of the body, the first rotation position at a first unarmed longitudinal position and the second rotational position at a second armed longitudinal position;

the safety interlock comprising at least one interlock member, the at least one interlock member having a first a locked position that inhibits movement of the firing pin from the initial position in the firing direction and second unlocked that does not inhibit movement of the firing pin from the initial position in the firing direction;

wherein the firing mechanism is configured such that:

when the collar is in the unarmed position and the at least one safety interlock member is in said locked position the safety interlock member is prevented from moving from the locked position to the unlocked position; and when the collar is in the armed position the at least one locking member is able to be displaced to the unlocked position.

25. A firing mechanism as claimed in claim 24, in which the actuator mechanism is a toggle actuator, the arming collar engaging with the actuator toggle when in its unarmed position to inhibit the toggle from actuating the firing pin, the arming collar being disengaged from the actuator toggle when in its armed position collar so as not to inhibit the actuator toggle from actuating the firing pin.

26. A grenade comprising a firing mechanism as claimed in claim 24, wherein the grenade further comprises a munitions compartment connected to the body of the firing mechanism.

27. A grenade as acclaimed in claim 26, in which the munitions compartment is releasably connected to the body by means of a threaded connection.

28. A grenade as claimed in claim 26, wherein the munitions compartment is adapted to hold a primer charge which can be struck by the fining pin when the firing pin is moved in a firing direction by the actuator.

29. A grenade as claimed in any one of claims 26, in which the grenade is selected from the group comprising: a flash grenade, a stun grenade, a training grenade, a deflagrating grenade, and an explosive grenade.

* * * * *